US010871286B2

(12) United States Patent
Andersson et al.

(10) Patent No.: US 10,871,286 B2
(45) Date of Patent: Dec. 22, 2020

(54) BED MATERIAL FOR BUBBLING FLUIDISED BED COMBUSTION

(71) Applicant: Improbed AB, Malmo (SE)

(72) Inventors: Bengt-Ake Andersson, Molnycke (SE); Fredrik Lind, Torslanda (SE); Henrik Thunman, Partille (SE)

( * ) Notice: Subject to any disclaimer, the term of this patent is extended or adjusted under 35 U.S.C. 154(b) by 0 days.

(21) Appl. No.: 15/537,233

(22) PCT Filed: Dec. 17, 2015

(86) PCT No.: PCT/EP2015/080264
§ 371 (c)(1),
(2) Date: Jun. 16, 2017

(87) PCT Pub. No.: WO2016/102310
PCT Pub. Date: Jun. 30, 2016

(65) Prior Publication Data

US 2018/0038586 A1 Feb. 8, 2018

(30) Foreign Application Priority Data

Dec. 22, 2014 (EP) ..... 14199853

(51) Int. Cl.
*F23C 10/00* (2006.01)
*F23C 10/20* (2006.01)
(Continued)

(52) U.S. Cl.
CPC ..... *F23C 10/20* (2013.01); *F23C 10/00* (2013.01); *F23C 10/12* (2013.01); *F23C 10/18* (2013.01);
(Continued)

(58) Field of Classification Search
CPC ..... F23C 10/12; F23C 10/18; F23C 10/20; F23C 10/00; F23G 5/30; F23G 2203/504
See application file for complete search history.

(56) References Cited

U.S. PATENT DOCUMENTS 6,460,472 B1 10/2002 Silvennoinen
2011/0182788 A1* 7/2011 Daugaard ..... B01D 46/38 423/210

FOREIGN PATENT DOCUMENTS

EP 0152529 8/1985
EP 0185931 7/1986
(Continued)

OTHER PUBLICATIONS

Bidwe et al., Use of ilmenite as an oxygen carrier in Chemical Looping Combustion-Batch and continuous dueal fluidized bed investigation. Energy Procedia 2011;4:433-440.
(Continued)

*Primary Examiner* — Alfred Basichas
(74) *Attorney, Agent, or Firm* — Casimir Jones, S.C.; Mary Ann D. Brow

(57) ABSTRACT

The invention is in the technical field of bubbling fluidized bed combustion and relates to the use of ilmenite particles with an average particle size <dp> between 0.1 mm and 1.8 mm as bed material for a bubbling fluidized bed (BFB) boiler with an excess air ratio (λ) below 1.3 and to a method for operating a bubbling fluidized bed (BFB) boiler, comprising carrying out the combustion process with a bubbling fluidized bed comprising ilmenite particles as defined in any one of claims 1 and 4-5; and setting the excess air ratio (λ) to a value below 1.3.

15 Claims, 4 Drawing Sheets

Figure 1:
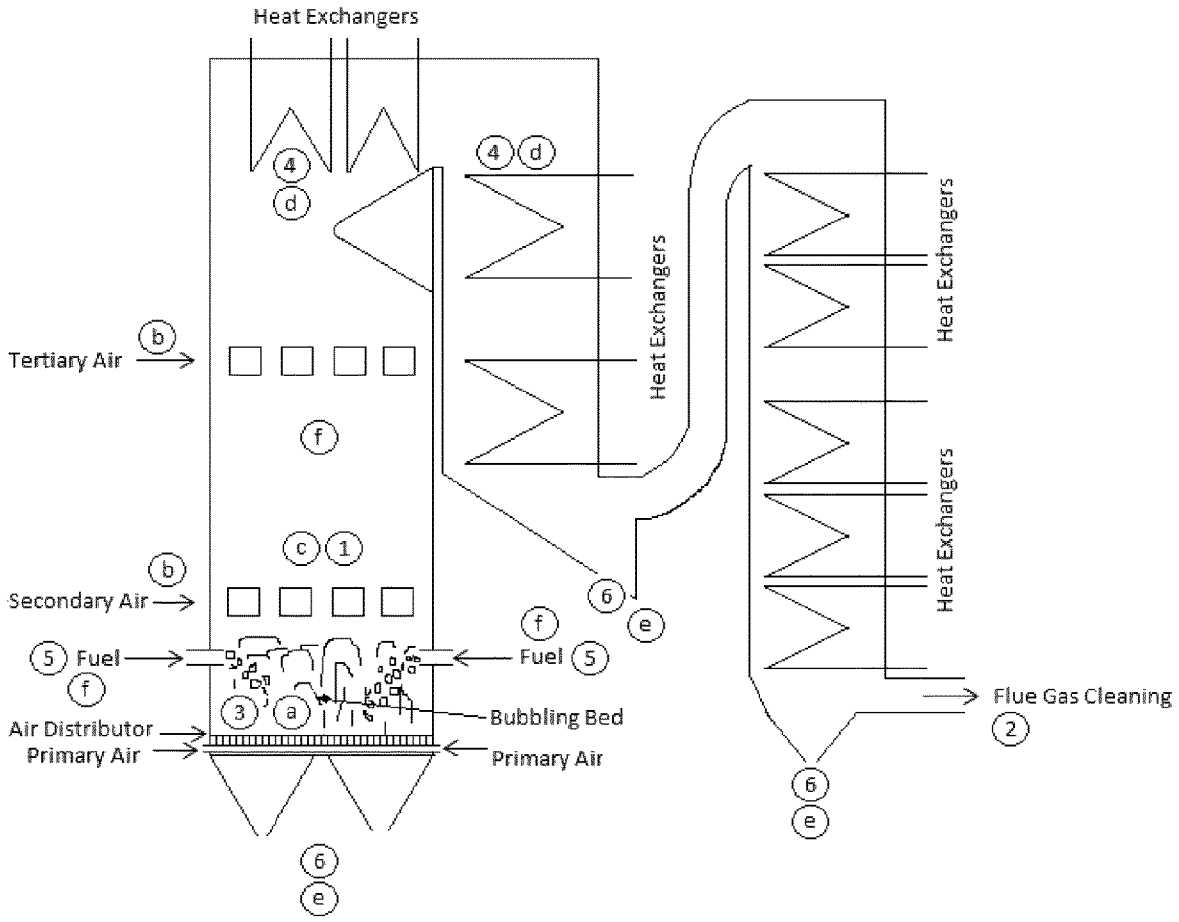

(51) Int. Cl.
*F23G 5/30* (2006.01)
*F23C 10/18* (2006.01)
*F23C 10/12* (2006.01)

(52) U.S. Cl.
CPC ..... *F23G 5/30* (2013.01); *F23G 2203/504* (2013.01)

(56) References Cited

FOREIGN PATENT DOCUMENTS

| | | |
|---|---|---|
| EP | 2503239 | 9/2012 |
| GB | 661560 | 11/1951 |

OTHER PUBLICATIONS

Thunman et al., Using an oxygen-carrier as bed material for comustion of biomass in a 12-MWth circulating fluidized-bed boiler. Fuel 2013;113:300-309.
International Search Report and Written Opinion for PCT/EP2015/080264 dated Mar. 10, 2016, 10 pages.

* cited by examiner

BED MATERIAL FOR BUBBLING FLUIDISED BED COMBUSTION

This application is a § 371 US National Entry of International Application No. PCT/EP2015/080264, filed Dec. 17, 2015, which claims the benefit of European Application No. 14199853.4, filed Dec. 22, 2014.

The invention is in the technical field of bubbling fluidized bed combustion and relates to the use of ilmenite particles in a bubbling fluidized bed boiler and to a method for operating a bubbling fluidized bed boiler.

In fluidized bed combustion (FBC) the fuel is suspended in a hot fluidized bed of solid particulate material. In this technique a fluidizing gas is passed with a specific fluidization velocity through a solid particulate bed material. At very low gas velocities, the bed remains static. Once the velocity of the fluidization gas rises above the minimum fluidization velocity ($u_{mf}$) at which the force of the fluidization gas balances the gravity force acting on the particles, the solid bed material behaves in many ways similar to a fluid and the bed is said to be fluidized. Two major types of fluidized bed combustion systems which are in practical use are bubbling fluidized bed (BFB) boilers and circulating fluidized bed (CFB) boilers.

BFB combustion has been developed as an alternative to grate boilers and is by now a mature technique for combusting a broad range of fuels. Grate boilers can exhibit comparatively large variations in temperature and fuel distribution. In the BFB technique a bed material, typically silica sand, is applied as a heat carrier to create a more even distribution of heat and fuel in the devolatilization and the char conversion zone. In BFB combustion, the fluidization gas velocity is above the minimum fluidization velocity and below the entrainment velocity at which the bed particles become entrained in the fluidization gas and are carried away by the fluidization gas stream. These fluidization gas velocities lead to the formation of bubbles in the bed, facilitating the transport of the gas through the bed material and allowing for a better control of the combustion conditions (better temperature and turbulence control) when compared with grate combustion. The technique is especially advantageous when combusting very moist fuels as the well-mixed bed material works as a heat magazine to even-out local cold zones arising from the conversion of wet fuel.

In BFB combustion, unburned fuel can be comprised in the fly ash which rises with the flue gas. This issue was addressed by the development of CFB boilers, which allow to recirculate unburned fuel. In CFB combustion the fluidization gas is passed through the bed material at a fluidization velocity above the entrainment velocity so that the solid particles are carried away by the fluidization gas stream. The particles are then separated from the gas stream and circulated back into the furnace by means of a loop seal.

Usually air is used as the fluidizing gas (so called primary air) and passed from below the bed through the bed material, thereby acting as a source of oxygen required for combustion. Even though fluidized beds are seen as systems providing good mixing between solid fuels and the bed material, in particular when compared to grate boilers, mixing is not perfect. Uneven mixing conditions with respect to fuel and oxygen in the furnace can arise for example due to streaking (the appearance of distinct gaseous streams in the furnace which are high in oxygen and have poor or no contact with the combustibles). To compensate for uneven mixing conditions, it is necessary to supply oxygen in excess of the amount required by stoichiometry in order to achieve essentially complete combustion. The excess air ratio depends on the heterogenicizy of the fuel and typically is 1.3. To this end, secondary and often tertiary air ports are distributed in strategic areas of the boiler (generally in the freeboard of the furnace) in order to ensure complete fuel combustion.

However, the supply of excess air to the boiler results in a reduction of boiler efficiency and can also lead to undesired environmental effects, such as, e.g., increased emission of carbon monoxide (CO), unburned hydrocarbons or nitrogen oxides ($NO_x$).

From the prior art it is known to use ilmenite as fluidized bed material in the CFB process (H. Thunman et al., Fuel 113 (2013) 300-309). The natural occurring mineral ilmenite is an iron titanium oxide ($FeTiO_3$) which can be repeatedly oxidized and reduced and thus acts as a redox material. Due to this reducing-oxidizing feature of ilmenite, the material can be utilized as an oxygen carrier in circulating fluidized bed (CFB) combustion. The investigation of ilmenite in CFB combustion was inspired by studies of ilmenite as solid oxygen carrying material in chemical-looping-combustion (CLC), where the solid oxygen carrying material is looped between oxygen rich and oxygen depleted environments. In the CFB process the ilmenite particles experience reducing conditions in the furnace and oxidizing conditions upon recirculation into the furnace.

The object of the invention is to provide means for efficient and cost effective bubbling fluidized bed combustion, in particular for continuously operated BFB boilers.

This object is solved by the use of claim 1 and the method of claim 6. Advantageous embodiments are defined in the dependent claims.

In particular, the invention has recognized that on the one hand the use of ilmenite particles with an average particle size <dp> between 0.1 mm and 1.8 mm as bed material for a bubbling fluidized bed (BFB) boiler with an excess air ratio (λ) below 1.3 and on the other hand a method for operating a bubbling fluidized bed (BFB) boiler, comprising:

a) carrying out the combustion process with a bubbling fluidized bed comprising ilmenite particles with an average particle size <dp> between 0.1 mm and 1.8 mm; and b) setting the excess air ratio (λ) to a value below 1.3, allow to carry out the bubbling fluidized bed combustion process with less excess air and thus closer to stoichiometric combustion, leading to an increase in efficiency.

The solution was unexpected, since a common feature of the prior art CLC and CFB processes is that there are separate zones where enriching/depleting oxygen conditions prevail. This therefore allows effective cycling of ilmenite in separate and delimited zones with clearly different combustion/reaction conditions. By contrast, bubbling fluidized bed combustion lacks these separate and delimited zones and it seemed counterintuitive that the oxygen supply capabilities of ilmenite could be exploited for BFB combustion.

The invention is based on the surprising discovery that in bubbling fluidized bed combustion the variation of the combustion parameters in situ is sufficient to take advantage of the ilmenite oxygen supply capability effectively equalizing out variations in air supply and combustion material. This makes it possible to reduce the excess air ratio (λ), which increases the efficiency and reduces emission problems, in particular the emission of CO, $NO_x$ and unburned hydrocarbons. The invention therefore allows to exploit the reducing-oxidizing effect of ilmenite in a single bubbling fluidized bed under continuous operation.

First, several terms are explained in the context of the invention.

The invention is directed to the use of ilmenite particles with an average particle size <dp> between 0.1 mm and 1.8 mm as bed material for a bubbling fluidized bed (BFB) boiler with an excess air ratio (λ) below 1.3.

In the context of the invention, the term bed material describes material intended to create the fluidized bed in the BFB system. It should be noted that fuel is no bed material. The term fuel describes the material that is to be combusted and comprises any fuel known to be combustable in BFB boilers, in particular biomass and waste-based fuel. Typical fuel materials are wood, agricultural biomass or sludge. The invention is not limited to the combustion of a particular type of fuel and encompasses the combustion of mixtures of different fuels.

The excess air ratio λ is a common parameter in the operation of BFB boilers and is defined as the mass ratio of air to fuel ($MR_{air/fuel}=m_{air}/m_{fuel}$) actually present in the combustion process divided by the stoichiometric mass ratio of air to fuel. That is, $\lambda=(MR_{air/fuel})_{actual}/(MR_{air/fuel})_{stoichiometric}$. The mass ratio of air to fuel actually present in the boiler is determined by the amount of fuel and air supplied to the boiler. The stoichiometric mass ratio of air to fuel is the mass ratio required by stoichiometry for complete combustion of the provided fuel and can be calculated for any given fuel composition.

The invention has recognized that the use of the inventive ilmenite particles as bed material in bubbling fluidized bed boilers allows for effective combustion at air to fuel ratios closer to the stoichiometric ratio, leading to a more efficient combustion process and less environmentally undesired emissions. According to the invention, the ilmenite particles are used as bed material for a BFB boiler with λ below 1.3.

In preferred embodiments, λ is 1.25 or less, more preferably 1.2 or less, more preferably 1.1 or less, most preferably between 1.05 and 1.1. Preferably, for the combustion of waste-based fuel, λ is 1.23 or less, more preferably 1.1 or less, more preferably between 1.05 and 1.23, most preferably between 1.05 and 1.1. For the combustion of biomass fuel, λ preferably is 1.19 or less, more preferably 1.1 or less, more preferably between 1.05 and 1.19, most preferably between 1.05 and 1.1.

The ilmenite particles used in the invention can for example be ilmenite sand, providing that the ilmenide sand particles meet the particle size requirement. Preferably, the ilmenite particles are crushed ilmenite.

In the context of the invention particle size (dp) can be measured by mechanical sieving. The mass captured on each sieve is weighed and the average particle size (<dp>) is calculated as mass weighted average value.

The average particle size of the ilmenite particles is preferably at least 0.2 mm, more preferably at least 0.3 mm, most preferably at least 0.4 mm. Preferably, the average particle size of the ilmenite particles is not more than 1.8 mm, more preferably not more than 1.0 mm, most preferably not more than 0.6 mm. In the context of the invention, each lower limit can be combined with each upper limit to define an average particle size range. Preferred ranges for the average ilmenite particle size are 0.2-1.8 mm, 0.3-1.0 mm and 0.4-0.6 mm, wherein the range of 0.4-0.6 mm is particularly preferred.

Preferably, the particle size of the ilmenite particles can be in the range from 0.1 mm to 1.8 mm, more preferrably in the range from 0.3 mm to 1.0 mm. In the context of the invention, any particle size range can be combined with any range for the average particle size. The above particle size ranges are particularly advantageous if the ilmenite particles are utilized with BFB boilers which have been designed for conventional bed materials, such as e.g. silica sand. Ilmenite is a denser material then the normally used silica sand, which affects the fluidization properties. Typically, the size of the silica sand particles in BFB systems can be in the range from 0.25 mm to 2.0 mm, preferably in the range from 0.5-1.2 mm, which corresponds to a particle size range from 0.1 mm to 1.8 mm and 0.3 mm to 1.0 mm for ilmenite particles, respectively. With the stated ilmenite particle size ranges the fluidization air/gas flow in the BFB boiler can be maintained similar to that used with silica sand. It is even more preferred, if in addition to these particle size ranges, the average particle size of the ilmenite particles is between 0.4-0.6 mm, since this range correspond to the preferred average particle size range for silica sand particles in BFB boilers (0.6-0.8 mm). In a particularly advantageous embodiment, the particle size of the ilmenite particles is in the range from 0.3 mm to 1.0 mm and the average particle size of the ilmenite particles is between 0.4 mm and 0.6 mm.

In an advantageous embodiment the ilmenite particles have been screened to exclude particles with a particle size too large to be fluidized or too small to be retained in the system. This improves the efficiency of the combustion process. Preferably, the screening comprises sieving off particles which are too small or too big.

In the context of the invention the ilmenite particles can be used as the only bed material in the furnace. However, it is also possible that the ilmenite particles are used in conjunction with one or more other bed materials. Conventional bed materials for BFB combustion are described in the prior art and known to the skilled person. A preferred bed material to be used in conjunction with the inventive ilmenite particles is silica sand. Preferably the size of the silica sand particles is in the range from 0.25 mm to 2.0 mm, more preferably in the range from 0.5 mm to 1.2 mm and/or the average particle size of the silica sand particles is between 0.6 mm and 0.8 mm. If the ilmenite particles are used in conjunction with the silica sand particles it is preferred that the particle size of the ilmenite particles is in the range from 0.3 mm to 1.0 mm and that the average particle size of the ilmenite particles is between 0.4 mm and 0.6 mm while the particle size of the silica sand particles is in the range from 0.5 mm to 1.2 mm and the average particle size of the silica sand particles is between 0.6 mm and 0.8 mm.

Preferably the ilmenite particles are used in an amount of at least 10% by weight, preferably at least 20% by weight, more preferably at least 30% by weight, more preferably at least 40% by weight, more preferably at least 50% by weight, more preferably at least 60% by weight, more preferably at least 70% by weight, more preferably at least 80% by weight, more preferably at least 90% by weight, most preferably at least 95% by weight of the mass of the total bed material.

In one advantageous embodiment the ilmenite particles are used as bed material for a bubbling fluidized bed boiler with continuous fuel supply. In another advantageous embodiment the inventive ilmenite particles are used as bed material for a bubbling fluidized bed boiler with batch fuel supply.

The fluidizing gas velocity is generally adjusted to accommodate the fluidizing properties of the bed material and the load range. In a preferred embodiment the inventive use comprises setting the fluidizing gas velocity to at least 0.03 m/s, preferably at least 0.13 m/s, more preferably at least 0.19 m/s, more preferably at least 0.25 m/s, more preferably at least 0.28 m/s, more preferably to a value between 0.3 and 2.0 m/s, most preferably to a value between 0.3 and 1.5 m/s.

A particularly preferred embodiment is directed to the use of ilmenite particles with a particle size (dp) in the range from 0.3 to 1.0 mm and/or an average particle size (<dp>) between 0.4 mm and 0.6 mm as bed material for a bubbling fluidized bed boiler, wherein the use comprises setting the fluidizing gas velocity to a value between 0.3 m/s and 1.5 m/s. This use is particularly preferred if it is intended to replace the silica sand particles in a conventional BFB boiler either entirely or partially with the ilmenite particles of the invention.

Conventional bed particles such as silica sand particles are prone to agglomerate when exposed to alkali-containing fuels. This may lead to boiler shutdown if no additional sand is added. The inventive ilmenite, however, absorbs alkali which reduces the risk of agglomeration and requires less frequent exchange of the bed material when, e.g., compared with silica sand. In a preferred embodiment, the inventive use comprises supplying the ilmenite particles to the boiler at a rate of less than 3 kg/MWh thermal output, more preferably at a rate of 1.5 kg/MWh thermal output or less, when biomass fuel is used and at a rate of less than 6 kg/MWh thermal output, more preferably at a rate of 3 kg/MWh thermal output or less, when waste-based fuel is used. If the ilmenite particles are used in conjunction with silica sand, the inventive use can preferably comprise supplying the silica sand particles to the boiler at a rate of 3 kg/MWh thermal output when biomass fuel is used and at a rate of 6 kg/MWh thermal output when waste-based fuel is used.

Furthermore, the absorption of alkali by the ilmenite particles decreases the risk for fouling and slagging on heat exchanger surfaces. This, together with the more efficient combustion due to the use of ilmenite particles makes it possible to use a wider fuel span.

During combustion in a BFB boiler, air is usually supplied both as primary fluidizing air via nozzles below the bed and as secondary (and possibly tertiary) air in the freeboard of the furnace. The invention has recognized that by exploiting the oxygen supply capabilities of ilmenite particles it is possible to achieve complete combustion with less or no secondary or tertiary air supply. A preferred embodiment is directed to the use of ilmenite particles in a BFB boiler, wherein at least 50%, preferably at least 70%, more preferably at least 80%, more preferably at least 90%, most preferably all of the combustion air is provided as primary fluidizing air.

A common problem with BFB boilers is the build-up of soot and/or deposits formed by inorganic material from the fuel and/or bed material in the system, in particular in the convection path. This requires sooting measures, i.e. measures to remove soot from the system, at regular intervals. It is not uncommon to have a sooting interval (interval between two sooting measures) of up to three times a day. That is, soot has to be removed daily. Preferably this is done via soot blowing. The invention has recognized that the use of the inventive ilmenite particles as bed material in a BFB boiler leads to a reduced build-up of soot in the system, in particular in the convection path. This means that the sooting interval can be extended. The frequency of soot removal, e.g. via soot blowing can be reduced. With the inventive ilmenite particles, the sooting interval is preferably at least 2 days, more preferably at least 3 days, more preferably at least 5 days, more preferably at least one week, more preferably at least two weeks, most preferably at least three weeks.

A particularly preferred use is with a continuously operated BFB boiler.

The invention is also directed to a method for operating a bubbling fluidized bed (BFB) boiler, comprising:

a) carrying out the combustion process with a bubbling fluidized bed comprising ilmenite particles with an average particle size <dp> between 0.1 mm and 1.8 mm; and b) setting the excess air ratio (λ) to a value below 1.3.

The features of the inventive method and the advantages of using ilmenite particles in the operation of a BFB boiler have already been discussed in the context of the inventive use, above. These features and advantages also apply to the inventive method discussed below.

In particular, the ilmenite particles comprised in the bed can for example be ilmenite sand, providing that the ilmenide sand particles meet the particle size requirement. Preferably, the ilmenite particles are crushed ilmenite.

The average particle size of the ilmenite particles is preferably at least 0.2 mm, more preferably at least 0.3 mm, most preferably at least 0.4 mm. Preferably, the average particle size of the ilmenite particles is not more than 1.8 mm, more preferably not more than 1.0 mm, most preferably not more than 0.6 mm. In the context of the invention, each lower limit can be combined with each upper limit to define an average particle size range. Preferred ranges for the average ilmenite particle size are 0.2-1.8 mm, 0.3-1.0 mm and 0.4-0.6 mm, wherein the range of 0.4-0.6 mm is particularly preferred.

Preferably, the particle size of the ilmenite particles can be in the range from 0.1 mm to 1.8 mm, more preferrably in the range from 0.3 mm to 1.0 mm. In the context of the invention, any particle size range can be combined with any range for the average particle size. The above particle size ranges are particularly advantageous if the method is directed to the operation of BFB boilers which have been designed for conventional bed materials, such as e.g. silica sand. Ilmenite is a denser material then the normally used silica sand, which affects the fluidization properties. Typically, the size of the silica sand particles in BFB systems can be in the range from 0.25 mm to 2.0 mm, preferably in the range from 0.5-1.2 mm, which corresponds to a particle size range from 0.1 mm to 1.8 mm and 0.3 mm to 1.0 mm for ilmenite particles, respectively. With the stated ilmenite particle size ranges the fluidization air/gas flow in the BFB boiler can be maintained similar to that used with silica sand. It is even more preferred, if in addition to these particle size ranges, the average particle size of the ilmenite particles is between 0.4-0.6 mm, since this range corresponds to the preferred average particle size range for silica sand particles in BFB boilers (0.6-0.8 mm). In a particularly advantageous embodiment, the particle size of the ilmenite particles is in the range from 0.3 mm to 1.0 mm and the average particle size of the ilmenite particles is between 0.4 mm and 0.6 mm.

In an advantageous embodiment the method comprises screening the ilmenite particles to exclude particles with a particle size too large to be fluidized or too small to be retained in the system before carrying out the combustion process. This improves the efficiency of the combustion process. Preferably, the screening comprises sieving off particles which are too small or too big.

In a preferred embodiment, the bubbling fluidized bed consists of ilmenite particles. In another preferred embodiment, the bubbling fluidized bed comprises ilmenite particles described above and further at least one other bed material. The at least one other bed material can be any conventional bed material for BFB combustion known in the prior art. A preferred bed material is silica sand. Preferably the size of the silica sand particles is in the range from 0.25 mm to 2.0 mm, more preferably in the range from 0.5 mm to 1.2 mm and/or the average particle size of the silica sand particles is between 0.6 mm and 0.8 mm. If the bed comprises ilmenite particles and silica sand particles it is further preferred that the particle size of the ilmenite particles is in the range from 0.3 mm to 1.0 mm and that the average particle size of the ilmenite particles is between 0.4 mm and 0.6 mm while the particle size of the silica sand particles is in the range from 0.5 mm to 1.2 mm and the average particle size of the silica sand particles is between 0.6 mm and 0.8 mm.

Preferably the bubbling fluidized bed comprises ilmenite particles in an amount of at least 10% by weight, preferably at least 20% by weight, more preferably at least 30% by weight, more preferably at least 40% by weight, more preferably at least 50% by weight, more preferably at least 60% by weight, more preferably at least 70% by weight, more preferably at least 80% by weight, more preferably at least 90% by weight, most preferably at least 95% by weight of the mass of the total bed material.

In a preferred embodiment the method comprises setting the fluidizing gas velocity to at least 0.03 m/s, preferably at least 0.13 m/s, more preferably at least 0.19 m/s, more preferably at least 0.25 m/s, more preferably at least 0.28 m/s, more preferably to a value between 0.3 and 2.0 m/s, most preferably to a value between 0.3 and 1.5 m/s.

A particularly preferred embodiment is directed to a method wherein the ilmenite particles have a particle size (dp) in the range from 0.3 to 1.0 mm and/or an average particle size (<dp>) between 0.4 mm and 0.6 mm and wherein the method comprises setting the fluidizing gas velocity to a value between 0.3 m/s and 1.5 m/s. This is particularly preferred for operating a BFB boiler designed to be used with conventional bed material, such as silica sand.

In a preferred embodiment, the inventive method comprises supplying the ilmenite particles to the BFB boiler at a rate of less than 3 kg/MWh thermal output, more preferably at a rate of 1.5 kg/MWh thermal output or less, when biomass fuel is used and at a rate of less than 6 kg/MWh thermal output, more preferably at a rate of 3 kg/MWh thermal output or less, when waste-based fuel is used.

In an advantageous embodiment the method comprises continuously supplying ilmenite particles to the BFB boiler.

In another advantageous embodiment the method comprises supplying ilmenite particles in batches.

If the bed further comprises silica sand, the method can preferably comprise supplying the silica sand particles to the BFB boiler at a rate of 3 kg/MWh thermal output when biomass fuel is used and at a rate of 6 kg/MWh thermal output when waste-based fuel is used.

Preferably, the method comprises supplying at least 50%, more preferably at least 70%, more preferably at least 80%, more preferably at least 90%, most preferably all of the combustion air as primary fluidizing air.

Preferably, the method provides for a sooting interval (interval between two sooting measures) of at least 2 days, more preferably at least 3 days, more preferably at least 5 days, more preferably at least one week, more preferably at least two weeks, most preferably at least three weeks.

In an advantageous embodiment the method comprises continuously supplying fuel to the BFB boiler. In another advantageous embodiment the method comprises supplying fuel in batches.

It is particularly preferred when the BFB boiler is operated continuously.

As described above, the inventive method results in a more efficient combustion process, in particular when compared to silica sand particles as bed material. This means that while maintaining the flue gas velocity the fuel throughput can be increased, which also increases the thermal capacity. Alternatively, maintaining the heat and/or power output, the fuel input can be decreased.

In the following, advantageous embodiments will be explained by way of example.

It is shown in

Figure 2:
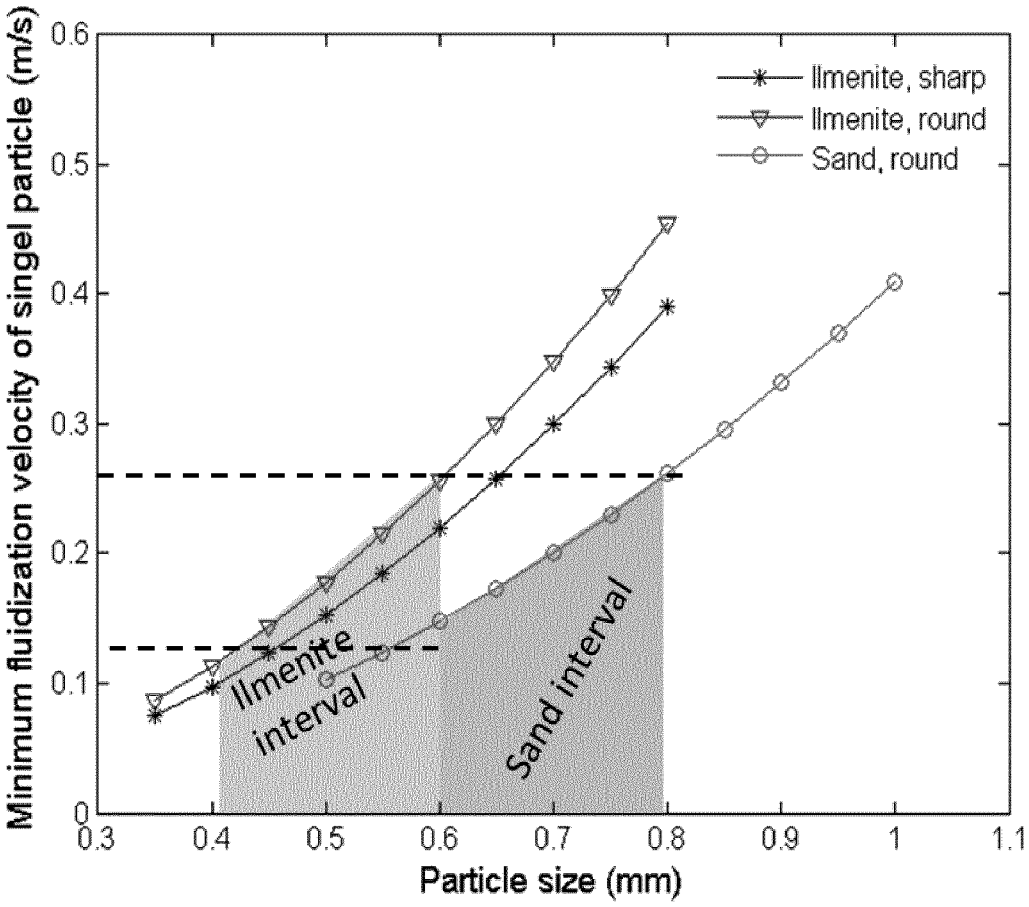
Figure 3:
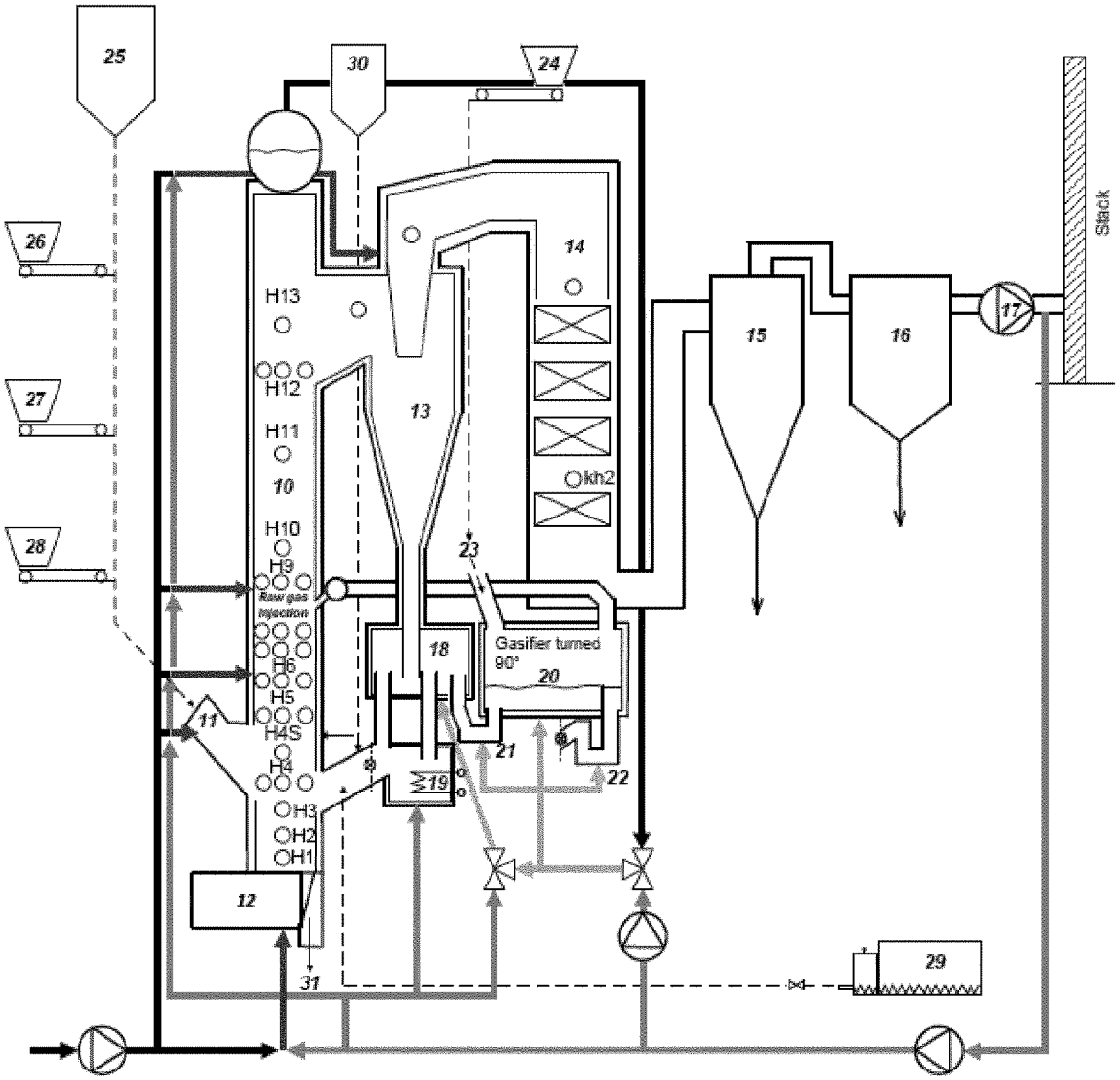
Figure 4:
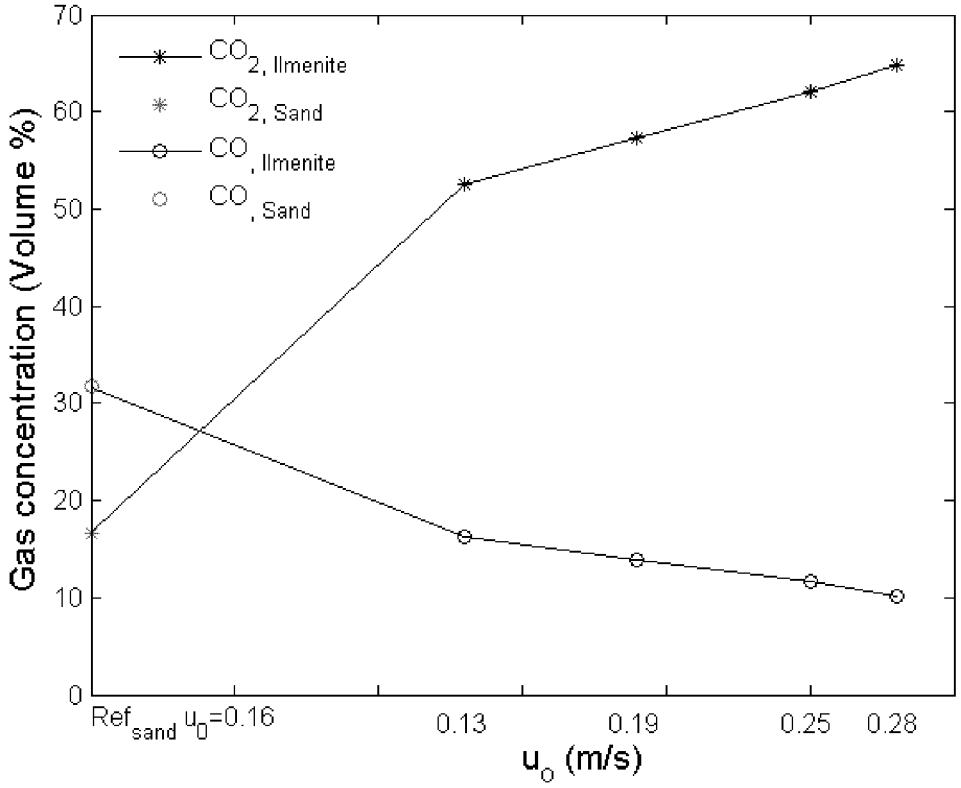
Figure 5:
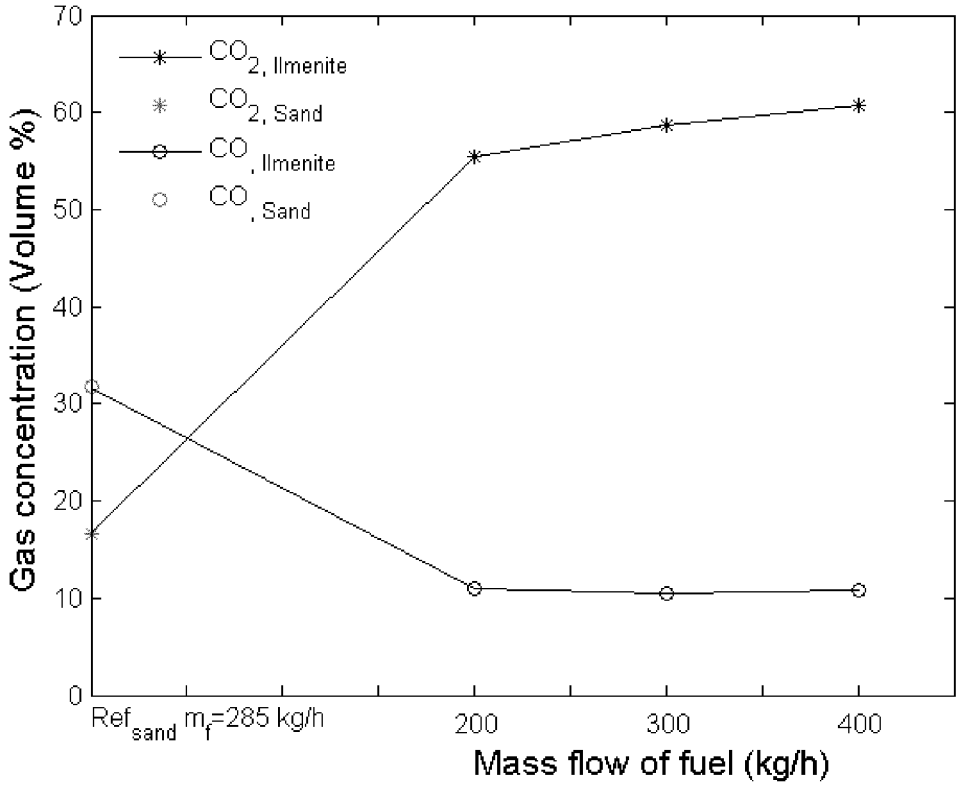

FIG. 1: a BFB boiler with a bubbling fluidized bed comprising ilmenite particles;

FIG. 2: fluidizing properties of silica sand and ilmenite in a bubbling fluidized bed;

FIG. 3: a schematic drawing of the boiler and gasifier system used for BFB experiments;

FIG. 4: CO and $CO_2$ concentration versus fluidization velocity for BFB combustion with ilmenite and silica sand as bed material;

FIG. 5: CO and $CO_2$ concentration versus fuel load for BFB combustion with ilmenite and silica sand as bed material.

EXAMPLE 1

FIG. 1 shows a BFB boiler (1), with primary air supplies (2) and an air distributor (3) at the bottom of the furnace (4) and secondary air ports (5) and tertiary air ports (6) in the freeboard of the furnace (4). Heat exchangers (7) and the flue gas cleaning line (8) are also shown. The fuel is fed, preferably continuously, through fuel ports (9) and is combusted in a bubbling fluidized bed (10) comprising ilmenite particles. Preferably, the bed material consists of ilmenite particles with a particle size dp in the range from 0.3 mm to 1.0 mm and an average particle size <dp> between 0.4 mm and 0.6 mm. The ilmenite particles can be crushed rock ilmenite, which, before carrying out the combustion process, has been screened to exclude particles with a particle size too large to be fluidized and too small to be retained in the system by sieving off particles which are too large or too small.

The use of the ilmenite particles allows to operate the boiler closer to stoichiometric combustion. In particular, the boiler (1) is operated with an excess air ratio ($\lambda$) below 1.3, for example with $1.05<\lambda<1.23$ for waste fuel and with $1.05<\lambda<1.19$ for biomass fuel. Preferably $\lambda$ is set to a value between 1.05 and 1.1 for both types of fuel. The majority (>50%) of the combustion air is provided as primary air via the primary air supplies (2) and preferably all of the combustion air is provided as primary air. The boiler is operated with a fluidizing gas velocity between 0.3 and 1.5 m/s.

The use of the ilmenite particles in bed (10) leads to a better balanced oxygen distribution which enables a more complete combustion and reduces CO, $No_x$ and unburned carbon emissions in the flue gas line (8).

The ilmenite particles in the bed can absorb alkali and are therefore less prone to agglomeration when compared with silica sand bed material. This allows to extend the exchange rate for the bed material. The ilmenite particles are supplied to the boiler at a rate of 1.5 kg/MWh thermal output or less when biomass fuel is used and at a rate of 3 kg/MWh thermal output when waste based fuel is used.

Alternatively, boiler (1) is operated with a mixture of ilmenite particles and silica sand particles as bed material with particle ratios disclosed in the general part of the description. In this case, it is preferred that the silica sand particles have a particle size dp in the range from 0.5 mm to 1.2 mm and that the average particle size <dp> of the silica sand particles is between 0.6 mm and 0.8 mm.

EXAMPLE 2

Particle Size of Bed Material in a BFB Boiler

The particle size (dp) in a fluidized bed application should be determined to suit the purpose of the application. The particle size affects the fluid dynamics and also the amount of fluidizing media needed. The recommended average particle size of sand in a BFB-boiler is between 0.6-0.8 mm. The sand particle size distribution can be within the interval of 0.5 1.2 mm. Additional parameters that affect the fluid dynamics in a boiler are e.g.: solids density ($\rho_s$), the sphericity ($\Phi_s$) of the particles and the voidage ($\varepsilon$) created between the particles in the bed. It is possible to estimate the "behavior" for fluid dynamics of different bed materials, and one parameter which is commonly used is the minimum fluidization velocity ($u_{mf}$). This velocity gives information about when the bed material starts to fluidize. There are three major paths to determine the $u_{mf}$, 1), experimentally, 2), theoretical calculations or 3), semi-empiric calculations. Here, a semi-empirical calculation route has been used. The calculation is based on the Ergun equation (1) (Kunii D., Levenspiel O., Fluidization Engineering, second edition, Butterworth-Heinemann, 1991):

$$\frac{1.75}{\varepsilon_{mf}^3 \cdot \Phi_s} \cdot \mathrm{Re}_{,mf}^2 + \frac{150 \cdot (1 - \varepsilon_{mf})}{\varepsilon_{mf}^3 \cdot \Phi_s^2} \cdot \mathrm{Re}_{,mf}^2 = AR \quad (1)$$

Where $\mathrm{Re}_{mf}$ is calculated according to Eq. 2, where $\rho_f$ is the density of the fluid and $\nu$ is the kinematic viscosity of the gas.

$$\mathrm{Re}_{mf} = \frac{dp \cdot u_{mf} \cdot \rho_f}{\nu} \quad (2)$$

The Archimedes number (AR) is calculated according to Eq. 3, where g is the gravimetric constant.

$$AR = \frac{dp^3 \cdot \rho_f (\rho_s - \rho_f) \cdot g}{\nu^2} \quad (3)$$

The $\Phi_s$ of the particles have been received but not the $\varepsilon_{mf}$ number. The $\varepsilon_{mf}$ number is here calculated via a semi-empiric correlation presented by Wen and Yu (Wen C. Y., Yu Y. H., A generalized method for predicting minimum fluidization velocity, American Institute of Chemical Engineers, Vol. 12, Issue 3, May 1966, pages 610-622) according to Eq. 4

$$14 = \frac{1}{\Phi_s \cdot \varepsilon_{mf}^3} \quad (4)$$

Two different ilmenites have been considered, 1), one Norwegian rock ilmenite with a $\Phi_s$ of 0.7 on the fresh particles (which has been determined at the University of Chalmers), 2), one round ilmenite with a $\Phi_s$ of 0.86 which corresponds to the $\Phi_s$ of silica-sand. The results from the calculations are presented in FIG. 2 as $u_{mf}$ versus dp for the two ilmenites and the ordinary silica-sand. If the recommendation for silica-sand is considered to be the basis for the average particle size, and if the comparison is built on fulfilling the same $u_{mf}$, then the corresponding average ilmenit dp is given in the blue shaded area of the plot. If keeping the same $u_{mf}$ as the basis for the heavier ilmenite then the same volume flow of fluidization media can be considered to be valid. There are two obvious advantages with this choice, 1), ordinary gas flows or even lower can be considered, which is positive as the volume flow of gases and fan capacity in a combustion system usually is a restriction, 2), a smaller particle size promotes the oxygen-carrying effects as more surface area is initiated and a better gas/solid contact can be expected in the splash zone above the bed.

EXAMPLE 3

1) Setup Used for BFB Experiments

A 2-4 $MW_{th}$ gasifier system at Chalmers University of Technology was used for BFB combustion experiments with ilmenite. It is of the type indirect gasification. In this technique, the actual gasification reactions are separated from the combustion reactions and the heat needed for the endothermic gasification reactions is supplied by a hot circulating bed material. The bubbling fluidized bed gasifier is connected to the 12 $MW_{th}$ circulating fluidized bed boiler and the two reactors are communicating via the bed material, see FIG. 3. Fuel is fed on top of the bed in the gasifier and the gasifier is fluidized with pure steam. Usually the system is operated with silica-sand and the gasifier is operated in the temperature interval of 750-830° C. FIG. 2 shows the boiler and gasifier setup, wherein the reference numerals indicate:

10 furnace
11 fuel feeding (furnace)
12 wind box
13 cyclone
14 convection path
15 secondary cyclone
16 textile filter
17 fluegas fan
18 particle distributor
19 particle cooler
20 gasifier
21 particle seal 1
22 particle seal 2
23 fuel feeding (gasifier)
24 fuel hopper (gasifier)
25 hopper
26 fuel hopper 1
27 fuel hopper 2
28 fuel hopper 3
29 sludge pump
30 hopper
31 ash removal
32 measurement ports 2) Ilmenite Operation in the Gasifier Variations in Fluidization Velocity at Constant Fuel Feed With the aim of investigating gas/solid contact between the volatiles and the bed material, the gasifier was operated with 100 wt. % of ilmenite with an average particle size of 0.14 mm as bed material for a few days. The first experiment was conducted at four different steam flows yielding a variety in gas velocities: 0.13, 0.19, 0.25 and 0.28 m/s, which corresponds to 5, 7, 9 and 11 times the minimum fluidization velocity of the ilmenite fraction. During this experiment the gasifier was continuously fed with 300 kg of fuel (wood-pellets) per hour and the bed temperature was kept at 820-830° C. FIG. 4 shows the analyzed gas components $CO_2$ and CO in the outlet of the gasifier during ilmenite operation. Data for ordinary silica-sand during normal gasification conditions (Ref, sand, marker color red) has been added in the figure for comparison with the ilmenite. As can be seen in FIG. 4, the CO concentration is clearly decreased and the $CO_2$ concentration is increased by almost a factor 4 when ilmenite is used in comparison to the silica-sand operation. As the gasifier is fluidized with pure steam all the extra oxygen supplied for the increased oxidation of hydrocarbons and CO is coupled to the oxygen-carrying properties of the ilmenite. This further shows the oxygen buffering effects that ilmenit possesses and the ability to transport oxygen from oxygen rich to oxygen depleted zones during fuel conversion. The fluidization conditions and gas solid contact in the gasifier can be compared to the conditions in a BFB-boiler and it is therefore likely that ilmenite will contribute with increasing oxygen transport also in a BFB boiler.

Variation in Fuel Feed During Constant Fluidization Velocity

The second experiment was conducted during a constant steam flow of 200 kg/h (yielding a gas velocity of 0.19 m/s, corresponding to 7 times the minimum fluidization velocity) and a variation in fuel feed: 200, 300 and 400 $kg_{fuel}$/hour (wood pellets). FIG. 5 shows the measured gas concentrations of CO and $CO_2$ in the outlet of the gasifier. The trend is very similar to the one in FIG. 4, a clearly decreasing CO concentration as a function of the oxygen transport via the ilmenite. The $CO_2$ concentration also reveals that hydrocarbons are combusted and not only CO is oxidized. This result shows that even though the fuel feed is increased from 200 to 400 kg/h there is still oxygen enough to support the oxidation of CO and hydrocarbons.

During combustion in a fluidized bed boiler, air is usually supplied both as primary air via nozzles below the bed and as secondary air in the freeboard of the furnace. The experiments in the gasifier show that a high fuel conversion can be achieved via the buffered oxygen in the ilmenite bed, i.e. without any addition of air at all. This means that a high degree of oxidation of the volatiles is conducted already in/or close to the bed and suggests the operation of a BFB boiler with less or no secondary air.

The preliminary tests indicate that an excess air ratio of 1.23 or less can be achieved for waste. It is suggested that an excess air ratio of 1.19 or less can be achieved for biomass fuel.

The invention claimed is:

1. A method, comprising:

i) providing an amount of ilmenite particles with an average particle size between 0.1 mm and 1.8 mm as bed material in a furnace with a bubbling fluidized bed boiler, wherein the amount of ilmenite particles as a proportion of total bed mass is at least 20% by weight, and ii) operating the bubbling fluidized bed boiler for combustion of biomass fuel or waste-based fuel with an excess air ratio λ, below 1.3, wherein in a single bubbling fluidized bed boiler operated under continuous conditions, the ilmenite particles exhibit a reducing-oxidizing effect utilized during the combustion.

2. The method of claim 1, wherein λ, is 1.25 or less.

3. The method of claim 1, wherein λ, for the combustion of waste-based fuel is 1.23 or less.

4. The method of claim 1, wherein i) the ilmenite particles have an average particle size that is at least 0.2 mm; and that is not more than 1.8 mm;

and/or ii) the ilmenite particles have a particle size in the range from 0.1 mm to 1.8 mm.

5. The method according to claim 1, characterized in that the ilmenite is crushed rock ilmenite.

6. A method for operating a bubbling fluidized bed boiler, comprising:

a) carrying out a biomass fuel or waste-based fuel combustion process in a furnace with a bubbling fluidized bed comprising ilmenite particles having an average particle size between 0.1 mm and 1.8 mm wherein the amount of ilmenite particles as a proportion of total bed mass is at least 20% by weight, wherein in a single bubbling fluidized bed boiler operated under continuous conditions, the ilmenite particles exhibit a reducing-oxidizing effect utilized during the combustion process; and b) setting an excess air ratio λ, in the furnace to a value below 1.3.

7. The method of claim 6, wherein λ, is set to 1.25 or less.

8. The method of claim 6, wherein λ, for the combustion of waste-based fuel is set to 1.23 or less.

9. The method of claim 6, wherein the bubbling fluidized bed further comprises silica sand particles, wherein i) the silica sand particles have a particle size in the range from 0.25 mm to 2.0 mm; and/or ii) the silica sand particles have an average particle size between 0.6 mm and 0.8 mm.

10. The method of claim 6, wherein the amount of ilmenite particles as a proportion of the total bed mass is at least 30% by weight.

11. The method of claim 6, characterized by setting the fluidizing gas velocity to at least 0.03 m/s.

12. The method of claim 6, characterized by providing at least 50% of the combustion air as primary fluidizing air.

13. The method of claim 6, characterized by a sooting interval of at least 2 days.

14. The method of claim 6, wherein fuel and/or the ilmenite particles are continuously supplied to the bubbling fluidized bed boiler.

15. The method of claim 6, wherein the ilmenite particles are supplied to the bubbling fluidized bed boiler at a rate of less than 3 kg/MWh thermal output when biomass fuel is used; and at a rate of less than 6 kg/MWh thermal output when waste-based fuel is used.

* * * * *